US005170772A

United States Patent [19]

Hamm

[11] Patent Number: 5,170,772

[45] Date of Patent: Dec. 15, 1992

[54] FINE ADJUSTMENT MECHANISM FOR BOWSTRING RELEASE

[76] Inventor: Harry Hamm, 6210 Wintergreen Dr., Wisconsin Rapids, Wis. 54494

[21] Appl. No.: 719,729

[22] Filed: Jun. 24, 1991

[51] Int. Cl.[5] ..... F41B 5/00

[52] U.S. Cl. ..... 124/35.2; 81/90.9

[58] Field of Search ..... 124/31, 35.1, 35.2; 81/90.1, 90.2, 90.3, 90.4, 90.6, 90.8, 90.9

[56] References Cited

U.S. PATENT DOCUMENTS

| | | | |
|---|---|---|---|
| 1,351,217 | 8/1920 | Richard | 81/90.6 |
| 1,539,943 | 6/1925 | Greve | 81/90.6 |
| 4,257,386 | 3/1981 | Gazzara | 124/35.2 |
| 4,282,851 | 8/1981 | Lyons | 124/35.2 |
| 4,407,260 | 10/1983 | Lyons | 124/35.2 |
| 5,067,472 | 11/1991 | Vogel et al. | 124/35.2 |

*Primary Examiner*—Randolph A. Reese
*Assistant Examiner*—Jeffrey L. Thompson
*Attorney, Agent, or Firm*—Stroud, Stroud, Willink, Thompson & Howard

[57] ABSTRACT

A caliper-jaws type release which includes a cam-shaped pin for pivotally holding one of two opposing jaws in the release holder. The cam-shaped pin has a head portion, an eccentric middle portion of smaller diameter than the head portion and a concentric end portion of smaller diameter than the middle portion. The head portion has a recess in its top surface for receiving a lever having a complimentary projection. Inserting the lever into the complimentary recess permits the cam-shaped pin to be rotated. The eccentric portion pivotally engages the jaw. Rotating the cam-shaped pin with the lever causes the jaw to change position relative to the opposing jaw.

2 Claims, 2 Drawing Sheets

FINE ADJUSTMENT MECHANISM FOR BOWSTRING RELEASE

FIELD OF THE INVENTION

The invention pertains to the general subject of archery and in particular, to the subject of mechanical bowstring or arrow releases.

BACKGROUND OF THE INVENTION

A popular type of mechanical bowstring release is the caliper-jaws type bowstring release. Caliper-jaws type bowstring releases are designed with caliper type jaws that are generally spring activated to move from a closed position to an open position when a trigger for the release is squeezed. An example of a caliper-jaws type bowstring is the Scott TM bowstring release. In use, the release usually is secured to the wrist by a strap with the working part of the release resting between the archer's thumb and index finger, being positioned so that the index finger can actuate the trigger. The jaws of the release are closed around the bowstring and the bowstring is withdrawn by pulling the release back. At the desired moment, the bowstring is released by actuating the trigger which opens the jaws. The advantage of such a release is that the bowstring is released smoothly without the "punching" which often accompanies manual release of the bowstring.

Purchasers of a caliper-jaws type bowstring release wish to have the jaws closely approximated, with little or no gap between them, when in a closed position. A release in which the jaws are not closely approximated when in the closed position will often be rejected by the scrutinizing consumer. Furthermore, a release in which the jaws are not closely approximated when in the closed position may not function properly and either fail to adequately close around the bowstring or permit premature release of the bowstring.

Manufacturing caliper-jaws type releases so that there is little or no gap between the jaws when in a closed position requires adherence to manufacturing tolerances which are expensive to maintain. Maintaining expensive manufacturing standards is not always practical when the product is a relatively inexpensive consumer item such as the caliper-jaws type bowstring release. The invention disclosed and claimed herein permits fine adjustment of the approximation of the jaws after manufacture and assembly of the release, thus relieving the manufacture of strict adherence to expensive manufacturing tolerances.

SUMMARY OF THE INVENTION

A cam-shaped pin is described which pivotally holds, in the body or holder of the release, one of the jaws of a caliper-jaws type release. The portion of the cam-shaped pin about which the jaw pivots is eccentric so that rotating the pin causes the jaw to change position relative to the opposing jaw. The use of such a pin allows for fine adjustment of the position of the jaw relative to the opposing jaw and corrects slight errors in manufacture which would otherwise result in a gap between opposing jaw in the closed position.

Figure 1:
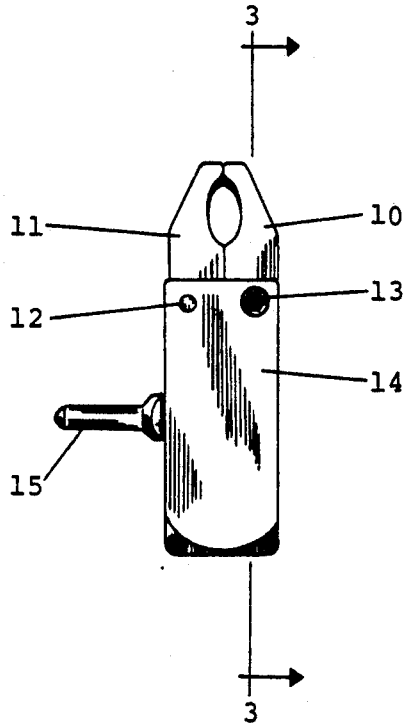
FIG. 1 is a plan view of a caliper-jaws type bowstring release with the jaws in the closed position.

FIGS. *6a* & *6b* is a plan view of the caliper-jaws type release of the present invention illustrating fine adjustment of the approximation of the jaws.

DETAILED DESCRIPTION OF THE INVENTION

While this invention is susceptible of embodiment in many different forms, there is shown in the drawings and will herein be described in detail one specific embodiment of the invention. It should be understood, however, that the present disclosure is to be considered as an exemplification of the principals of the invention and is not intended to limit the invention to the specific embodiments illustrated.

Figure 2:
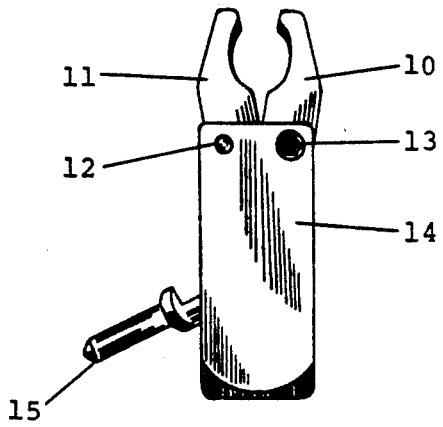
FIG. 2 is a plan view of a caliper-jaws type bowstring release with the jaws in the open position.

Turning to FIG. 1, a caliper-jaws type bowstring release with its jaws in the closed position is illustrated showing the opposing caliper-jaws, 10 and 11, which pivot on two pins, and 13, a holder for the jaws, 14 and a trigger, 15. FIG. 2 illustrates the same caliper-jaws type bowstring release with its jaws in the open position. Note that the trigger 15 has been actuated thereby releasing the jaws which are forced open by a spring.

Figure 6:
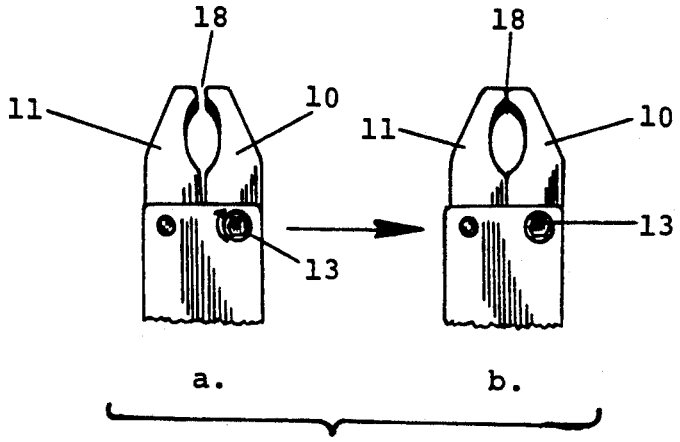

FIG. 6 illustrates the caliper-jaws in a closed position. Note the gap 18 between the opposed jaws in FIG. *6a*. A gap between the opposed jaws in the closed position can result from minor errors in the machining of the jaws. Such a gap may cause the release to malfunction or may cause the release to be rejected by the consumer. In the present invention the problem of a gap between opposed jaws in the closed position is avoided by using a cam-shaped pin 13.

Figure 3:
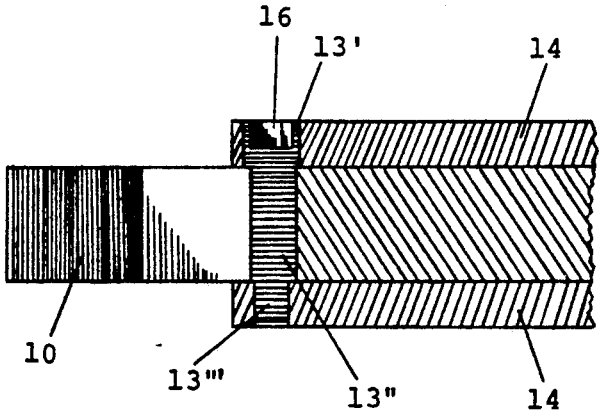
FIG. 3 is a cross section view through 3—3 of FIG. 1.
Figure 5:
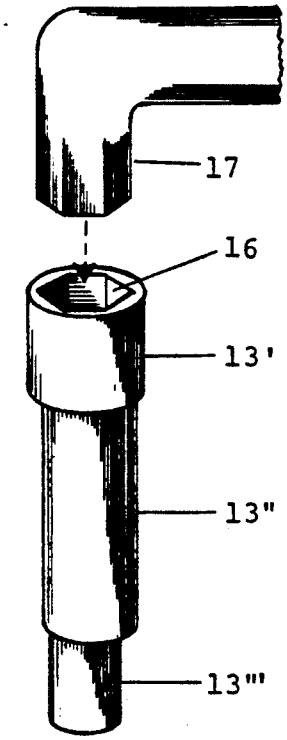
FIG. 5 illustrates an allen wrench and one embodiment of a cam-shaped pin having a depression on the top surface of its head compatible with the allen wrench.
Figure 4:
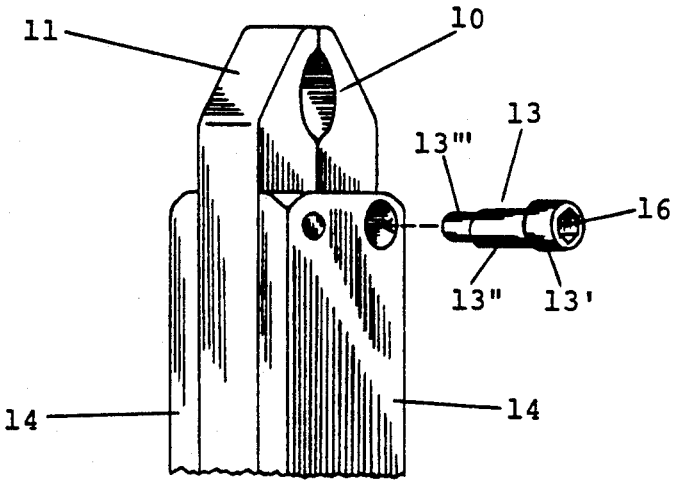
FIG. 4 is a three dimensional exploded view illustrating how the cam shaped pin fits into the release.

As illustrated in FIGS. 3–5 the cam-shaped pin of the preferred embodiment has a head portion 13', an eccentric middle portion 13'' of somewhat smaller diameter than the head portion, and a concentric end portion 13''' of smaller diameter than the middle portion. Preferably the pin is fabricated from hardened steel or aluminum. As shown in FIGS. 3 and 4, the cam-shaped pin is inserted into complementary holes of the holder and jaw and positioned so that the head 13' and end 13''' portions are engaged in complementary holes of the holder, whereas the eccentric portion 13'' is engaged in a complementary hole of the jaw. The holes of the holder must be large enough so that the cam-shaped pin can be inserted but small enough so that the head portion 13' and end portion 13''' are snugly seated in the holder. The complementary hole in the jaw must be large enough so that the jaw can pivot about the eccentric portion, but not so large so as to permit the jaw to wobble.

In FIG. 5, the cam-shaped pin 13 of the preferred embodiment is provided with a hex-shaped recess or depression 16 on the top surface of the head portion 13' for receiving an allen wrench. This provides a means for rotating the cam-shaped pin once it has been seated in the release. Other means for rotating the cam-shaped pin may be used including slotted means for receiving conventional or phillips-type screwdrivers or a flattened extension which could be gripped by a pliers.

In operation, once the cam-shaped pin is seated, gaps which occur between opposed jaws in the closed position (FIG. 6*a*) may be corrected by merely rotating the cam-shaped pin as illustrated. Because the eccentric portion 13" engages the jaw, rotating the cam-shaped pin causes the jaw to shift position relative to the holder and the opposing jaw, thus closing the gap 18, FIG. 6*b*.

From the foregoing description, it will be observed that numerous variations, alternatives and modifications will be apparent to those skilled in the art. Accordingly, this description is to be construed as illustrative only, and is for the purpose of teaching those skilled in the art the manner of carrying out the invention. Various changes may be made in the shape, size, and arrangement of parts. In addition, equivalent elements may be substituted for those illustrated and described herein, parts may be reversed and certain features of the invention may be utilized independently of other features of the invention. For example, one may eliminate the end portion of the cam-shaped pin and achieve the same result provided the pin is securely seated in the holder by just the head portion. It will be appreciated that various modifications, alternatives, variations, etc., may be made without departing from the spirit and scope of the invention as defined in the appended claims. It is, of course, intended to cover, by the appended claims, all such modifications as fall within the scope of the claims.

I claim:

1. A caliper-jaws type bowstring release, comprising:

(a) two opposing jaws;

(b) a slotted holder for said jaws;

(c) two pins for pivotally attaching said jaws to said holder, said holder having holes in which each of said pins is snugly engaged and said jaws having pivot holes in which each of said pins is loosely engaged;

(d) at least one of said pins being a cam-shaped pin and having a head portion, an eccentric middle portion, and a smaller concentric end portion, said cam-shaped pin engaging one of said jaws with said eccentric portion, said head portion leaving a means for rotating said cam-shaped pin.

2. In a caliper-jaws type bowstring release having two opposing jaws which move between an open position and a closed position, a slotted holder for said jaws, and two pins providing means for pivotally attaching said jaws to said holder, the improvement being:

at least one of said pins being a cam-shaped pin, having a head portion, an eccentric middle portion and a smaller concentric end portion, said cam-shaped pin engaging said holder with said head portion and end portion and pivotally engaging one of said jaws with said eccentric portion, said head portion having a means for rotating said cam-shaped pin.

* * * * *

UNITED STATES PATENT AND TRADEMARK OFFICE
Certificate

Patent No. 5,170,772 Patented: December 15, 1992

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Harry Hamm, Wisconsin Rapids, WI; Brian H. Hamm, Wisconsin Rapids, WI.

Signed and Sealed this Twenty-First Day of March, 2000.

LESLIE A. BRAUN
Supervisory Patent Examiner,
Art Unit 3632